United States Patent [19]

Sutter et al.

[11] 4,300,711

[45] Nov. 17, 1981

[54] APPARATUS FOR THE PNEUMATIC TRANSPORT OF TEXTILE BAND MATERIAL

[75] Inventors: Hans P. Sutter; Josef Hartmann, both of Uster, Switzerland

[73] Assignee: Luwa AG, Zurich, Switzerland

[21] Appl. No.: 130,059

[22] Filed: Mar. 13, 1980

[30] Foreign Application Priority Data

Mar. 23, 1979 [CH] Switzerland ..... 2720/79

[51] Int. Cl.[3] ..... B65H 17/32

[52] U.S. Cl. ..... 226/97; 226/108; 226/118

[58] Field of Search ..... 226/95, 108, 109, 118, 226/119

[56] References Cited

U.S. PATENT DOCUMENTS

| | | | |
|---|---|---|---|
| 3,122,295 | 2/1964 | Davison | 226/97 X |
| 3,502,253 | 3/1970 | Mallekom | 226/97 |
| 3,813,900 | 6/1974 | Cook | 226/97 |
| 3,944,166 | 3/1976 | Hermanns | 226/97 |

*Primary Examiner*—Edward J. McCarthy
*Attorney, Agent, or Firm*—Werner W. Kleeman

[57] ABSTRACT

Tubes or conduits, guiding slubbing or roving or the like during pneumatic transport thereof, terminate at a box or cabinet which delimits a compartment connected with the suction side of a ventilator. Within the compartment there is provided for each tube an elongate delay space or chamber, through which pass the slubbing while supported by guide elements, whereas the slubbing-transport air flows off into the compartment by means of throughpass openings. Between outfeed or outlet openings, through which the slubbing departs from the box, and the delay spaces or chambers there are provided dam-up spaces through which there does not flow the transport air and into which there also cannot enter any ambient or outside air, since the band-outlet openings are closed by closure elements, typically pairs of rolls acting as sealing elements. The dam-up spaces permit a brief storage of the incoming slubbing or the like. The box has a tiltable cover, by means of which access to the interior of the box is afforded in order to draw-in the slubbing.

13 Claims, 3 Drawing Figures

APPARATUS FOR THE PNEUMATIC TRANSPORT OF TEXTILE BAND MATERIAL

CROSS REFERENCE TO RELATED CASE

The present invention is related to the commonly assigned, copending United States application Ser. No. 06/130,058 filed Mar. 13, 1980, entitled "COILER ARRANGEMENT".

BACKGROUND OF THE INVENTION

The present invention relates to a new and improved construction of apparatus for the pneumatic transport of band-like textile material especially sliver, slubbing or roving, which apparatus is of the type comprising at least one transport tube or conduit having a delivery or outfeed end which is operatively connected in flow communication by means of a compartment with the suction side of a ventilator, there also being provided a textile band-outlet opening, and the compartment contains means for the support of the band-like textile material.

As stated, the transport apparatus of the invention is particularly suitable for handling sliver, slubbing or roving, but generally may be used with most types of band-like textile materials, and therefore these terms used individually or collectively, in any combinations, are intended as being employed in their broader sense to encompass not only sliver, slubbing or roving as such, but other band-like textile materials.

Equipment is known to the art by means of which it is possible to pneumatically transport textile fiber bands, such as slivers, within tubes or conduits. Such equipment, for the most part still in the experimental stage, aims at simplifying the transport of the band-like textile material, for instance slubbing or roving, while reducing the number of manual operations which have to be performed. Typically, the transport of the band-like textile material is for instance between a card and a drafting arrangement. A further purpose of this type of apparatus is, to the extent that the situation requires, avoidance of any intermediate storage of the transport textile material in a can or the like. On the other hand, such equipment also beneficially enables reducing the annoying presence of dust and other contaminants emanating from the fibrous material within the textile machine halls or rooms containing the equipment, in order to thereby, in conjunction with appropriate measures carried out at the textile machine, to also fulfil strict requirements concerning the working conditions and health hazards as pertains to the machine operators.

During the pneumatic transport of slivers and, in particular, slubbing or rovings which typically are moved by the action of a suction air current, the danger exists of damaging or rupturing the slubbing or the like during such time as the transport air is separated from the conveyed band-like textile material. With a heretofore known apparatus of this type the outfeed or delivery end of the transport tube is connected with a compartment. The slubbing is guided in this compartment over a rotating perforated roll or drum and is supported thereon, whereas the suction air flows off through perforations or holes at the durm surface. A second roll or drum which coacts with the first roll or drum supports the slubbing during the subsequent pressure equalization which takes place.

While the state-of-the-art apparatus is capable of preventing damage to the slubbing or the like, its use is limited to equipment where the peripheral velocity of the drums is (at least) equal to the transport velocity of the slubbing. Apart from the foregoing, such type apparatus is afflicted with the drawback of requiring a considerable amount of space by virtue of the support rolls which are needed and, furthermore, there is required a relatively great expenditure in mechanical equipment.

SUMMARY OF THE INVENTION

Therefore, with the foregoing in mind it is a primary object of the present invention to provide a new and improved construction of apparatus of the character described which extensively avoids the aforementioned drawbacks.

Yet a further significant object of the present invention is directed to the provision of a new and improved construction of apparatus for the pneumatic transport of band-like textile materials in an extremely efficient, reliable and protective manner.

Still a further significant object of the present invention is concerned with providing a new and improved construction of pneumatic transport apparatus for band-like textile materials, wherein the textile material is conveyed in a reliable, accurate and protective manner through the transport apparatus, and such apparatus is relatively simple in construction and design, economical to manufacture, not readily subject to breakdown or malfunction and requires a minimum of maintenance and servicing.

Now in order to implement these and still further objects of the invention, which will become more readily apparent as the description proceeds, the apparatus of the present development is manifested by the features that there is arranged at least one elongate or extended delay space or chamber within the compartment and which directly merges at the outfeed or discharge end of the transport tube. The delay space or chamber extends in the direction of travel of the textile band material and is formed by stationary guide elements. These guide elements delimit therebetween throughpass openings whose total cross-sectional area is greater than the inner cross-sectional area of the transport tube or conduit. Also, there are provided revolving closure or sealing elements which are operatively associated with the aforementioned band outlet or discharge opening.

By virture of the reduction in the flow velocity of the textile band-transport air, the inventive apparatus enables separation of the transport air from the band material without damaging such band material. On the other hand, the guide elements which are provided afford for the band material, to the extend needed, the requisite supporting action and prevent any departure thereof into the compartment, even then when such is not in a stretched or elongated position. Preferably, the guiding of the air within the compartment is selected such that the transport air is sucked-off practically completely through the throughpass openings.

What is important in terms of avoiding damage to the textile band material at the end of its pneumatic transport path is also the recognition that no air flowing into the compartment from the surroundings or outside should come into contact with such band material. Therefore, it is decisive that at the band outlet or discharge opening there is prevented the entry of ambient air, something which can be accomplished for instance by the use of sealing or closure elements constructed, typically for instance as rolls or belt pairs.

The apparatus has particular significance in those environments of use where the transport velocity of the band material is greater than the requirements of the subsequently arranged consumer, i.e., the next following textile processing machine. In these instances the equipment permits periodic storage of the textile band material in the delay space or chamber. As the amount of stored material increases the transport velocity of the band material within the transport tube or conduit is reduced by virtue of the automatic throttling of the air between the tube discharge end and the compartment, which is a consequence of the material collecting because the amount of infed material is greater than the requirements of the consumer. Once the stored quantity of textile material has been depleted, then there is reestablished the original transport velocity of the textile band material and this process repeats, as needed. The delivery rate or quantity of the apparatus therefore automatically accommodates itself, and free of any disturbance, to the requirements of the consumer.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
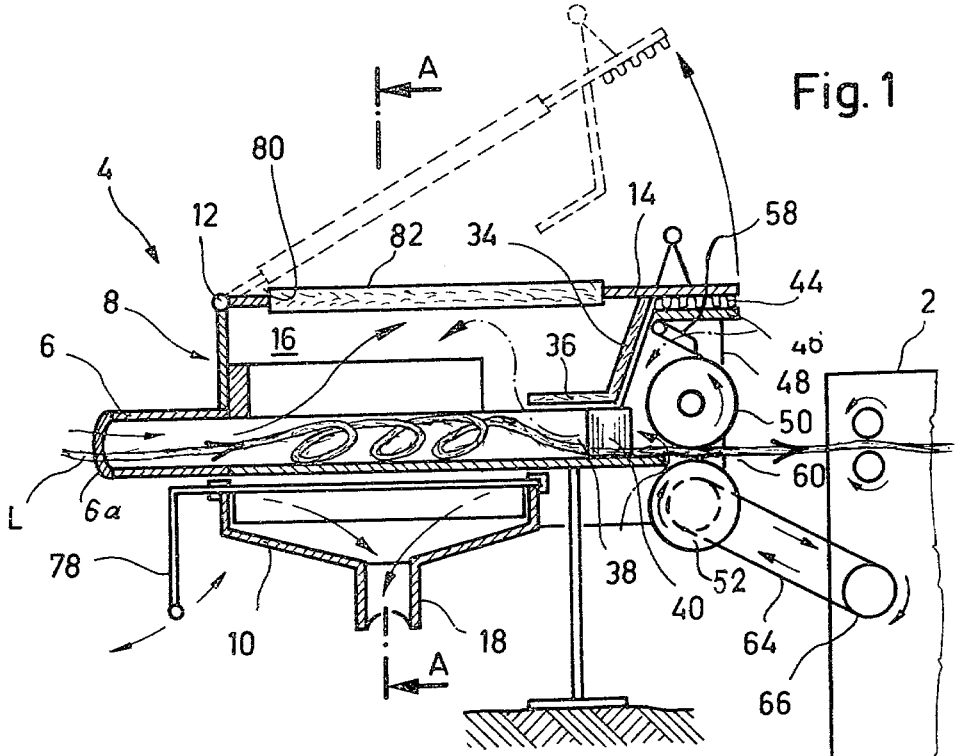
FIG. 1 is a vertical sectional view of part of the pneumatic transport apparatus of the invention, here shown operatively correlated with a drafting arrangement constituting the textile consumer, the section being taken substantially along the line B—B of FIG. 2.

Describing now the drawings, it is to be understood that only enough of the structure of the apparatus has been shown therein as will enable those skilled in the art to readily understand the underlying principles and concepts of the present development, while simplifying the illustration. Turning attention now specifically to FIG. 1, it will be recognized that an exemplary embodiment of pneumatic transport apparatus 4 is arranged between a textile processing machine or consumer, here shown as a conventional drafting arrangement 2 and a not particularly illustrated textile band-supply can or container. As far as the pneumatic transport apparatus 4 is concerned there has been specifically illustrated only the outfeed or delivery end thereof, since that portion of the equipment is specifically designed in accordance with the invention. This transport apparatus 4 contains a plurality of transport tubes or conduits, generally indicated by reference character *6a*, the outfeed or delivery ends 6 of which open into a receiver or take-up box or cabinet, generally designated by reference character 8. The box or cabinet 8 comprises an approximately vat-shaped lower portion 10 and a cover or closure member 14 which is pivotably mounted at the lower portion 10 by any suitable hinges 12 or the like. The lower portion 10 and cover 14 collectively delimit a compartment 16 which, in turn, is operatively connected in flow communication via a suction line or conduit 18 which opens into the lower portion 10, with the suction side 20*a* of a ventilator 20 or equivalent structure.

The compartment 16 contains a number of elongate or extended band delay spaces or chambers 22, and in each delay space 22 there opens one of the related transport tubes or conduits 6*a* at its discharge end 6. The tube mouths have been generally indicated in FIG. 2 by reference character 24. The delay spaces 22 possess a substantially rectangular cross-sectional configuration and are bounded in each instance at three sides by the guide plates 26 and 28 and at the fourth side by groups of guide rods or bars 30. The guide rods or bars 30, which extend essentially parallel to the guide plates 26 and 28, have an elongate cross-sectional configuration or profile and are arranged in an essentially upright position, as best seen by referring to FIG. 2. These guide rods 30 define the upwardly directed rectangle side, i.e. the top side of the corresponding delay space or chamber 22. The spaced guide rods 30 bound therebetween throughpass openings or outlets 32, by means of which the delay spaces or chambers 22 flow communicate with the compartment 16. Rigidly connected with the cover member 14 is a downwardly protruding wall portion 34 which delimits the compartment 16, this wall portion 34 carrying an essentially horizontally extending end portion 36. While the guide rods 30 terminate in spaced relationship from the end portion 36, the guide plates 26 and 28 extend past the wall portion 34, and the end portion 36 of the wall portion 34 bears upon the not particularly referenced end faces of the guide plates 28. The end portion 36 in coaction with the guide plates 26 and 28 bounds the dam-up spaces or chambers 38, which are completely open in the direction of the related band delay space or chamber 22, while such dam-up spaces 38, in the opposite direction, terminate at guide elements 40, as best seen by referring to FIGS. 1 and 3. It will be seen that two guide elements 40, each of which possess an approximately semi-circular cross-sectional configuration, are mounted at the guide plate 28 so that they are located opposite one another and thus bound a passage or passageway 42 of reduced or constricted cross-section. Further, each of the dam-up spaces 38 merges with its related band delay space 22 and is arranged externally of the compartment 16 bounded by the lower portion 10 and cover 14 of the box 8.

Figure 2:
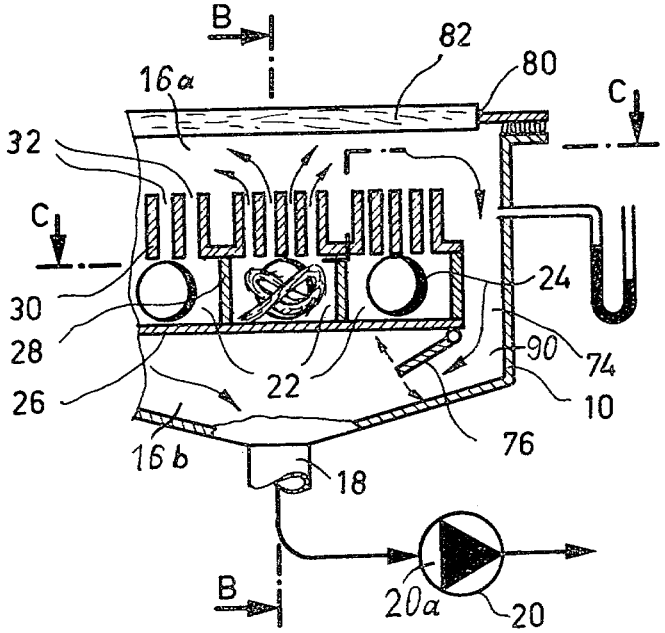
FIG. 2 is a fragmentary sectional view of the apparatus of FIG. 1, taken substantially along the line A—A thereof.

Continuing, it will be observed by referring to FIGS. 1 and 2 that the cover 14 bears by means of its free end, via a sealing ledge 44, upon a connection plate 46, with which there are connected substantially trapezoidal-shaped extensions 48 of the guide plates 28. Between the extensions 48 there are formed band outlet or discharge openings 60, with which there are operatively associated subsequent pairs of rolls or rollers 50 and 52. All of the rollers 50 are secured to one shaft 54 and the other rollers 52 to another shaft 56. While the rolls or rollers 52 are completely formed of metal, for instance steel, the rolls 50 are benefically equipped with a not particularly illustrated, but conventional elastically deformable bellows, for instance formed of rubber. Coacting with each of the rolls 50 and 52 is a sealing lip 58, wherein however as a matter of convenience in illustration there has only been shown the sealing lip 58 which coacts with the top roll 50 and at the same time forms a scraper or the like. The roll pairs 50, 52 seal-off the outlet or dicharge openings 60 completely by virture of the elastic covering of the rolls 50.

Figure 3:
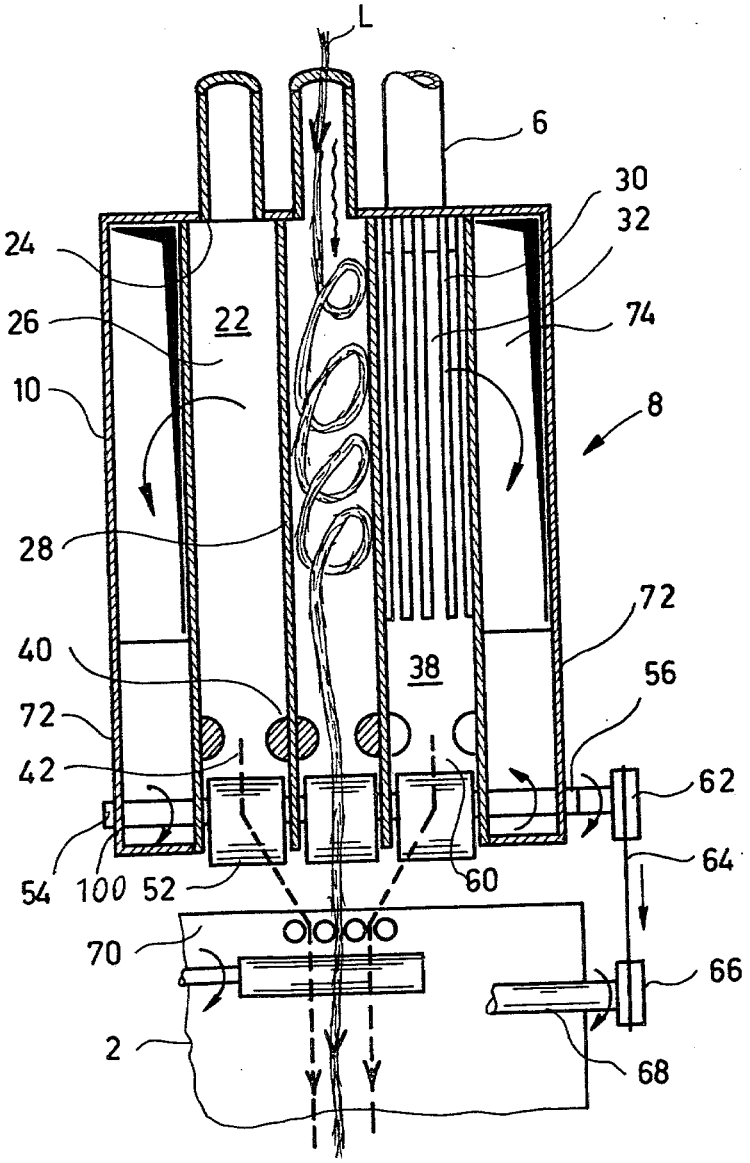
FIG. 3 is a horizontal sectional view of the arrangement of FIG. 2, taken substantially along the line C—C thereof.

As best observed by referring to FIG. 3, a belt pulley or disk 62 is seated upon the lower shaft 56, the belt pulley 62 being connected by means of a pulley belt 64 and a further pulley 66 with the power take-off shaft 68 of a textile machine 70, for instance as mentioned can be constituted by a drafting arrangement 2. The textile machine 70 is supplied by the transport apparatus 4 with the textile bands, and therefore, is arranged forwardly of the receiver box 8.

The shafts 54 and 56 are rotatably mounted in side portions or plates 72 of the box lower portion 10, and, if desired, the shaft 54 can be vertically displaced together with its bearings, as generally indicated by reference character 100 in FIG. 3. What is further here to be mentioned is that the part 16*a* of the compartment 16 which is located above the delay spaces or chambers 22 is connected in flow communication with the compartment part 16*b* located below the delay or retardation spaces 22 by means of two lateral chutes 74 which form air guide means. Both of the chutes 74 have operatively associated with their outlet sides 90 flow control elements, here shown in the form of throttle flaps or valves 76. These throttle flaps or valves 76 can be positionally adjusted by actuation arms 78 arranged externally of the box lower portion or part 10, as best seen by referring to FIG. 1. Finally, it is also further to be mentioned that the cover member 14 possesses a suitable control window 80 in which there is inserted a pane 82 formed of any suitable transparent material. The control window 80 is arranged at that region of the cover member 14 which is located over the delay spaces or chambers 22 in order to provide good visual access thereto.

Now when the textile machine 70 is in operation, here specifically the drafting arrangement 2, then as a general rule each transport tube or conduit 6*a* of the transport apparatus 4 contains a textile band, here in the form of a sliver, slubbing or roving L by way of example, which is withdrawn from a related can and which moves through the take-up or receiver box 8 into the drafting arrangement 2. The ventilator 20 is in operation and generates, by means of the suction line or conduit 18, the compartment 16 and the delay spaces or chambers 22, a transport air flow or current in all of the transport tubes or conduits 6*a*. The velocity of the transport air flow determines the transport velocity of the band-like textile material L i.e. here in the form of a sliver, slubbing or roving transport tubes 6*a* into the take-up or receiver box 8. On the other hand, the rolls 52 arranged upon the shaft 56, which in conjunction with the rolls 50 withdraw the textile band L out of the take-up or receiver box 8, are driven as a function of the production velocity of the drafting arrangement 2 by means of the power take-off shaft 68, the belt pulley 66, the belts 64 and the belt pulley 62 constituting a drive means for the shaft 56. Hence, the withdrawal speed of the slubbing L out of the take-up or receiver box 8 corresponds to the production speed of the textile machine. The transport velocity of the slubbing L within the related transport tubes 6*a* should be at least equal in magnitude to the withdrawal speed of the rolls 50 and 52, in order to prevent that tension stresses or forces will be applied to the slubbing L which arrive between the rolls 50 and 52. In order to positively satisfy such requirment, the transport velocity of the textile bands or slubbings L is adjusted, by means of the throttle flaps or valves 76, so as to be preferably somewhat greater than the withdrawal speed of the rolls 50 and 52. Hence, a greater amount of slubbing material arrives at the delay spaces or chambers 22 than the rolls 50 and 52 can draw-off.

Now as indicated in FIG. 1, in each delay space or chamber 22 there dams-up the not withdrawn slubbing L or other band-like textile material in the form of loops, so that textile material collects gradually before the mouths 24 of the tube ends 6. The accumulated textile material throttles the throughflow of transport air through the transport tubes or conduits 6*a*, and thus, reduces the transport velocity of the slubbings L within such transport tubes 6*a*. If the transport velocity of the slubbings L through the transport tubes 6*a* drops below the withdrawal speed of the rolls 50 and 52, then slubbing which has stored-up in the related band delay spaces 22 gradually diminshes. At the same time and in approximately the same degree the throttling action of this collection or dam-up material in front of the mouths 24 decreases, and thus, the transport velocity of the slubbings L within the transport tubes 6*a* again increases. As will be understood from the previous explanations, it is therefore not necessary that the transport velocity of the slubbings or the textile bands L within the transport tubes 6*a* correspond, at each point in time, to the withdrawl or outfeed speed of the rolls 50 and 52. In particular, it is also not necessary to act upon the transport velocity within the individual transport tubes 6*a*. Quite to the contrary, the transport velocities of the slubbings L within the transport tubes 6*a* can differ from one another to a limited degree, and the actual delivered quantity of textile material from each transport tube 6*a* automatically regulates itself to a constant value, which corresponds to the quantity of withdrawn material outfed by the rolls 50 and 52.

That separation of the transport air from the slubbings or textile bands L also is then possible when slubbing stores-up in the band delay spaces 22, is predicated in the first instance upon the fact that the slubbing can be supported over a path corresponding to the length of the related band delay space 22, namely over the length of the guide rods 32 at which such slubbing is supported, whereas the cross-sectional area which is available for the outlfow of the transport air increases in that the throughflow openings 32 extend in the direction of movement of the slubbing L. Since the throughflow openings 32 are upwardly directed and the chutes 74 extend approximately laterally of the throughflow openings 32, the transport air has the tendency to flow upwardly, so that within the delay spaces 22 there only is exerted upon the slubbings or textile bands L a low force which is effective in the direction of extent of the band delay spaces 22. The slubbings L have the tendency of depositing themselves upon the guide plates 26. To the extent that any slubbing is liftedoff or raised, during the outflow of air through the throughpass openings 32, then such raised slubbing can bear against the guide rods or bars 30.

Since no transport air flows into the dam-up spaces 38 and also there is prevented, as will be recalled, the entry of air through the band outlet or discharge openings 60 by the action of the rolls 50 and 52, no air flow is present in the dam-up spaces 38. Hence, upon entry into such dam-up spaces 38 the slubbing material only is exposed to the tension force of the rolls 50 and 52. The stored slubbing material remains for the most part in the delay spaces or chambers 22 and only tends to coil into the dam-up spaces 38 when a greater amount of slubbing material has collected. However, the guide elements 40, in any case, prevent drawing-out of slubbing material from the dam-up spaces 38 in the form of coils or loops. Quite to the contrary, these guide elements 40 guide the slubbing L along a predetermined path through the outlet or discharge openings 60, and thus, between the roll pairs 50, 52. Dust which has detached from the slubbing or roving L is continuously sucked-off through the compartment 16 into the suction line or conduit 18. The scrapers 58 keep the surfaces of the rolls 50 and 52 clean of dust depositions or the like in conventional manner.

While the control window 80 renders possible visual inspection and monitoring of the transport apparatus 4, upon tilting or pivoting open the cover member 14 it is possible to have physical access to the interior of the take-up or receiver box 8. Thus, for instance, when placing the drafting arrangement 2 into operation the cover member 14 is then opened after, following placement of the ventilator 20 into operation, a slubbing starting portion appears in each delay space or chamber 22, which previously was introduced into the related transport tube **6*b* from a corresponding can. The slubbing starting portion is then manually drawn through the dam-up spaces 38 between the guide elements 40 and between the rolls 50, 52 and then is pulled into the drafting arrangement 2. Now the cover member 14 is again reclosed. Of course, it is also possible to prevent the need of manually threading the slubbing L between the related rolls 50, 52 in that, there may be provided and placed into operation suction elements at the exit side of the dam-up spaces or chambers 38 and possibly at the exit or outlet side of the rolls 50, 52, these suction elements pulling the slubbing starting portions out of the related delay spaces or chambers 22 and dam-up spaces 38 and feeding such slubbing starting portion between the corresponding rolls 50, 52. It is possible to use suction elements which are connected with the ventilator 20 by means of a switching valve which is installed in the suction line or conduit 18, and during operation of such suction elements there is interrupted the flow communication to the compartment 16**.

While there are shown described present preferred embodiments of the invention, it is to be distinctly understood that the invention is not limited thereto, but may be otherwise variously embodied and practised within the scope of the following claims. ACCORDINGLY,

What is claimed is:

1. An apparatus for the pneumatic transport of textile band material, especially slivers, slubbings or rovings, comprising:

at least one transport tube through which there is transported the textile band in a predetermined direction of travel;

said transport tube having a delivery end;

means defining a compartment;

said delivery end of said transport tube flow communicating with said compartment;

ventilator means having a suction side operatively connected with said compartment;

said means defining said compartment being provided with a band outlet opening for the exit of the textile band therefrom;

means for supporting the textile band provided for said compartment;

said supporting means for the textile band defining at least one elongate band delay chamber which directly merges with said delivery end of the transport tube;

said band delay chamber extending in the direction of travel of the textile band;

said band delay chamber being formed by guide elements constituting at least part of said textile band-supporting means;

said guide elements being structured so as to delimit therebetween throughpass openings whose total cross-sectional area is greater than the inner cross-sectional area of the transport tube; and revolving sealing means operatively associated with said band outlet opening.

2. The apparatus as defined in claim 1, wherein:

the cross-sectional area of the band delay chamber bounded by the guide elements is greater than the cross-sectional area of the transport tube;

means defining a dam-up space arranged externally of the compartment and merging with the band delay chamber; and p1 guide means provided for the dam-up space and arranged forwardly of the band outlet opening.

3. The apparatus as defined in claim 2, further including:

air guide means provided for said compartment; and said air guide means deflecting the air flowing through the throughpass openings aproximately transversely with respect to the direction of extent of the band delay chamber.

4. The apparatus as defined in claim 1, further including:

air guide means provided for said compartment; and said air guide means deflecting the air flowing through the throughpass openings approximately transversely with respect to the direction of extent of the band delay chamber.

5. The apparatus as defined in claim 2, further including:

a plurality of said transport tubes;

each of said transport tubes having operatively associated therewith a related one of said band delay chambers;

said compartment defining a common compartment for the band delay chambers of all of the transport tubes;

said band delay chambers being arranged to extend approximately horizontally within said common compartment;

said means defining said dam-up space defines a respective dam-up space for each of the band delay chambers; and said dam-up spaces possessing a cross-section which is closed at all sides.

6. The apparatus as defined in claim 5, wherein:

said band delay chambers possess a substantially rectangular cross-sectional configuration; and said throughpass openings being arranged at one side of the rectangular configured band delay chambers.

7. The apparatus as defined in claim 6, wherein:

said throughpass openings being provided at a side of the rectangular configured band delay chambers which is directed upstream with respect to the direction of travel of the textile band; and said upstream directed side being defined by the narrow sides of a group of guide rods having elongate cross-sectional configuration and defining part of said guide elements.

8. The apparatus as defined in claim 7, wherein:
said means defining said compartment comprises box means; and
detachable cover means provided at an upper end of said box means.

9. The apparatus as defined in claim 8, further including:
suction line means for flow communicating said ventilator means with said compartment; and
said suction line means opening below the band delay chambers into said box means.

10. The apparatus as defined in claim 9, further including:
adjusting throttle means arranged between said throughpass openings and a mouth of said suction line means.

11. The apparatus as defined in claim 10, wherein:
said adjustable throttle means comprises flap means.

12. The apparatus as defined in claim 10, wherein:
said sealing means comprising at least one pair of rolls;
sealing ledge means attached to the box means and functioning as scraper means;
the rolls of each roll pair being seated upon respective common mutually parallel shafts rotatably mounted at said box means;
drive means provided for one of the shafts; and
a resilient surface covering provided for the rolls of the other shaft.

13. The apparatus as defined in claim 9, wherein:
said cover means of said box means contains a control window at a region located over the band delay chambers.

* * * * *